US008537188B2

(12) United States Patent
Ishii et al.

(10) Patent No.: US 8,537,188 B2
(45) Date of Patent: Sep. 17, 2013

(54) PORTABLE THERMAL PRINTER

(75) Inventors: Hiroyasu Ishii, Shizuoka (JP); Motohito Tsuchiya, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 44 days.

(21) Appl. No.: 13/397,788

(22) Filed: Feb. 16, 2012

(65) Prior Publication Data

US 2012/0212559 A1 Aug. 23, 2012

(30) Foreign Application Priority Data

Feb. 22, 2011 (JP) ..... 2011-35964

(51) Int. Cl.
*B41J 15/16* (2006.01)

(52) U.S. Cl.
USPC ..... 347/218; 347/220

(58) Field of Classification Search
USPC ..... 347/218, 220; 400/648
See application file for complete search history.

(56) References Cited

U.S. PATENT DOCUMENTS 4,435,062 A * 3/1984 Cocco ..... 396/582
7,852,360 B2 * 12/2010 Takahashi ..... 347/198
7,891,893 B2 * 2/2011 Sekino et al. ..... 400/188
2005/0232679 A1 * 10/2005 Na et al. ..... 400/649
2006/0221171 A1 * 10/2006 Watanabe et al. ..... 347/215
2012/0133722 A1 * 5/2012 Mori et al. ..... 347/197

FOREIGN PATENT DOCUMENTS

JP 58-148783 9/1983
JP 2009-006621 1/2009
JP 2009-173353 8/2009

OTHER PUBLICATIONS

Notification of Reasons for Refusal for Application No. 2011-035964 Dated Oct. 23, 2012, 6 pgs.

* cited by examiner

*Primary Examiner* — Huan Tran
(74) *Attorney, Agent, or Firm* — Turocy & Watson, LLP

(57) ABSTRACT

According to one embodiment, a portable thermal printer is disclosed. The portable thermal printer comprises: a housing provided with a thermal printer head; a cover openably attached to an opening portion of the housing by a pivotal shaft, the cover being provided with a platen roller arranged to make contact with the thermal printer head when the opening portion of the housing is closed by the cover; and a drive power source provided within the housing. The drive power source, the pivotal shaft and the platen roller are connected by a belt mechanism.

8 Claims, 7 Drawing Sheets

PORTABLE THERMAL PRINTER

CROSS-REFERENCE TO RELATED APPLICATION

This application is based upon and claims the benefit of priority from Japanese Patent Application No. 2011-035964 filed on Feb. 22, 2011, the entire content of which are incorporated herein by reference.

FIELD

Embodiments described herein relate generally to a portable thermal printer, which can be held by a user.

BACKGROUND

A thermal printer, which includes a thermal printer head composed of a heater element array extending in a width direction, is already commercially available. In the thermal printer, a thermal paper as a print paper is fed through between the thermal printer head and a platen roller rotating in contact with the thermal printer head. The thermal printer head performs printing while applying a constant pressure on the print paper.

In recent years, a portable thermal printer that can be held by a user has been developed as a thermal printer of the type described above. The portable thermal printer is easy to carry. For example, it can be carried to, e.g., a place of sale where a discount sale often called a special sale or a time-limited sale is underway and can be operated there to print any necessary information.

The portable thermal printer includes a drive power source with a driving gear arranged within a housing and a platen roller with a driven gear arranged in a cover for being able to open or close an opening portion of the housing. When the cover is kept closed with respect to the housing, the platen roller makes contact with a thermal printer head and the driven gear meshes with the driving gear.

Under these circumstances, the driven gear is exposed to the outside if the cover is opened. Thus, dusts or other alien substances are likely to adhere to the driven gear and may possibly be brought into between the driven gear and the driving gear, thereby hindering a smooth rotation of the platen roller. Accordingly, there is a strong demand for a portable thermal printer capable of assuring a smooth rotation of the platen roller.

DETAILED DESCRIPTION

According to one embodiment, a portable thermal printer includes a housing provided with a thermal printer head, and a cover openably attached to an opening portion of the housing by a pivotal shaft. The cover is provided with a platen roller arranged to make contact with the thermal printer head when the opening portion of the housing is closed by the cover. The portable thermal printer further includes a drive power source provided within the housing. The drive power source, the pivotal shaft and the platen roller are connected by a belt mechanism.

According to another embodiment, a portable thermal printer includes a housing provided with a thermal printer head, and a cover openably attached to an opening portion of the housing by a pivotal shaft. The cover is provided with a platen roller arranged to make contact with the thermal printer head when the opening portion of the housing is closed by the cover. The portable thermal printer further includes a drive power source provided within the housing. Further, the portable thermal printer includes a first pulley connected to the drive power source, a second pulley attached to the pivotal shaft, a third pulley arranged to rotate with being joined together with the second pulley, a fourth pulley attached to the platen roller, a driving belt stretched between the first pulley and the second pulley, and a driven belt stretched between the third pulley and the fourth pulley.

A portable thermal printer S according to the present embodiment will now be described with reference to the drawings.

Figure 1:
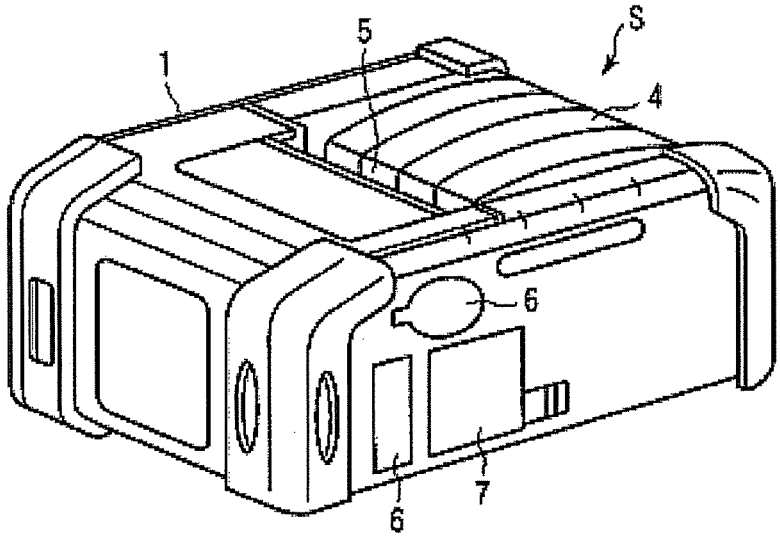
FIG. 1 is an external perspective view showing a portable thermal printer.
Figure 2:
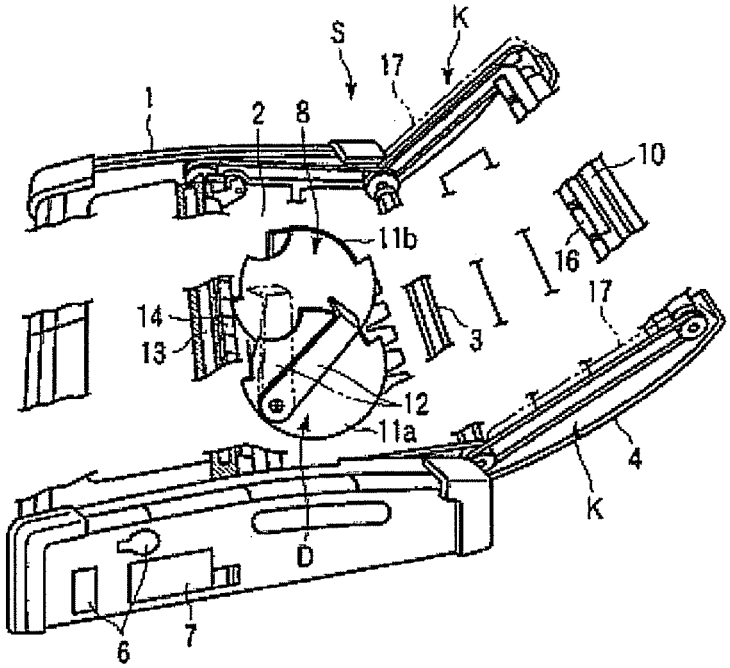
FIG. 2 is a schematic configuration view of the portable thermal printer with a cover opened.
Figure 3:
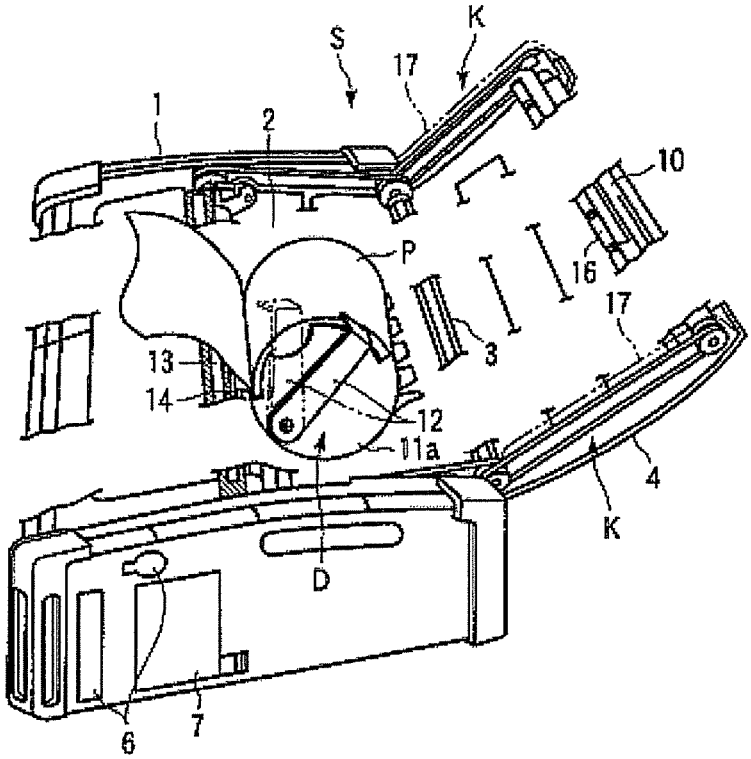
FIG. 3 is a schematic configuration view of the portable thermal printer having the cover being opened and a rolled paper loaded within the printer.

FIG. 1 is an external perspective view showing a portable thermal printer S with a cover 4 closed. FIG. 2 is a schematic configuration view of the portable thermal printer S with the cover 4 opened. FIG. 3 is a schematic configuration view of the portable thermal printer S with the cover 4 opened and a rolled paper P loaded within the printer.

In FIGS. 2 and 3, the printer S is divided into a plurality of portions along a width direction. If the portions are combined together at the dividing lines, then the width dimension of the printer S becomes substantially equal to the actual width dimension.

The portable thermal printer S is capable of performing two-inch printing and has a rectangular parallelepiped shape of about 88 mm in width, about 119 mm in length and about 65 mm in height. The weight of the portable thermal printer S with a battery is about 450 g. Due to the reduced weight thereof, the portable thermal printer S can be carried to any spot and be operated at the spot to perform printing as set forth later.

The printer S includes a housing 1 configured to hold therein all types of components of the printer S. The housing 1 can store a roll-shaped paper P as a thermal paper (the roll-shaped paper will be referred to as the "rolled paper" hereinafter). On the upper surface of the housing 1, there is defined an opening portion 2 through which the rolled paper P can be put into the housing 1. The opening portion 2 can be opened or closed by a cover 4 attached to the housing 1 through a pivotal shaft 3.

The pivotal shaft 3 is extended along the inside edge of the housing 1 forming one edge of the opening portion 2. When the cover 4 is closed, an elongated gap 5 is formed between the outer tip edge of the cover 4 and the side edge of the housing 1, i.e., one edge of the opening portion 2 that faces the outer tip edge of the cover 4. The gap 5 is extended in the width direction of the housing 1 over an area other than the both end areas of the housing 1.

The rolled paper P is drawn out from the gap 5 and the printed paper P is discharged through the gap 5 when the printing is finished. Thus, the gap 5 serves as a "paper outlet 5." The front edge of the housing 1 or the outer tip edge of the cover 4, which defines the paper outlet 5, is formed into a sharp shape to readily cut the rolled paper P discharged from the paper outlet 5. A connector portion 6 and a battery storage portion 7 are arranged on the right side surface of the housing 1.

A paper storage portion 8 storing the rolled paper P is defined within the housing 1. The rolled paper P is stored in the paper storage portion 8 with a roll axis thereof extending in the width direction of the housing 1. The rolled paper P is drawn by a below-mentioned platen roller 10 and conveyed toward the paper outlet 5.

When the rolled paper P is drawn by the platen roller 10, an oblique motion prevention mechanism D prevents the rolled paper P from making an oblique motion. The oblique motion prevention mechanism D includes a rail member that is extended in the width direction of the housing 1 and a pair of guide fences 11*a* and 11*b* slidably attached to the rail member in an opposing relationship (the oblique motion prevention mechanism D is partially shown). The guide fences 11*a* and 11*b* are connected to the both ends of a rack-and-pinion mechanism installed on the rail member. A lever 12 is pivotally attached to the outer surface of the right guide fence 11*a* when the printer S is seen from the front side.

Depending on the rotational position thereof, the lever 12 is either allowed to move in the longitudinal direction of the rail member or restrained from making such a movement. More specifically, as indicated by double-dot chain lines in FIGS. 2 and 3, the lever 12 is gripped and rotated toward the front side. Then, the lever 12 is moved to the right side of the printer S. The guide fences 11*a* and 11*b* are moved away from each other by the rack-and-pinion mechanism. The space between the guide fences 11*a* and 11*b* is used as the paper storage portion 8 stated above. Subsequently, the rolled paper P is stored in the paper storage portion 8.

If the lever 12 is moved to the left while keeping the lever 12 in the rotated position, then the guide fences 11*a* and 11*b* are moved toward each other by the rack-and-pinion mechanism. This makes it possible to bring the guide fences 11*a* and 11*b* into close contact with the left and right end surfaces of the rolled paper P stored between the guide fences 11*a* and 11*b*.

As indicated by solid lines in FIGS. 2 and 3, the lever 12 is rotated from this position to the inside. Thus, the movement of the lever 12 is restrained with the guide fences 11*a* and 11*b* kept in close contact with the both end surfaces of the rolled paper P. During a printing operation, the guide fences 11*a* and 11*b* kept in close contact with the both end surfaces of the rolled paper P serve to prevent the rolled paper P from making an oblique motion as it is fed out.

A thermal printer head 13 is arranged within the housing 1. The thermal printer head 13 includes a heater element array provided at the same direction as the width of paper. The heater element array generates heat under the control of a control unit not shown in the drawings, whereby the thermal printer head 13 performs printing on the rolled paper P.

A head bracket (not shown) for upwardly biasing inside the thermal printer head 13 is arranged at the front side of the thermal printer head 13. At the inside of the thermal printer head 13, there is arranged a head cover 14. If necessary, the head cover 14 is mounted to the housing 1. The head cover 14 presses and biases the thermal printer head 13 to prevent the occurrence of vibration in the thermal printer head 13.

A platen roller 10 as a paper feeding mechanism and a paper pressing roller 16 are arranged near the outer edge of one surface of the cover 4 facing the paper storage portion 8. The platen roller 10 and the paper pressing roller 16 are rotatably supported by support shafts extending in the width direction of the housing 1.

The platen roller 10 is arranged in the cover 4 so that when the cover 4 is closed, the platen roller 10 can be contacted with the heater element array of the thermal printer head 13. The paper pressing roller 16 is arranged in the cover 4 so that when the cover 4 is closed, the paper pressing roller 16 can be contacted with the head cover 14.

Within the housing 1, a belt mechanism K to be described below is provided. When seen at the front side of the printer S, the belt mechanism K is extended from the left and right end portions of the thermal printer head 13 to the left and right end portions of the platen roller 10 through the left and right end portions of the pivotal shaft 3 supporting the cover 4. Since the portions of the belt mechanism K that is extended from the left and right end portions of the thermal printer head 13 to the left and right end portions of the pivotal shaft 3 are installed within the housing 1, there is a little possibility that even if the cover 4 is opened, the belt mechanism K is partially touched by the fingers of an operator.

In contrast, the remaining portions of the belt mechanism K that is extended from the left and right end portions of the pivotal shaft 3 to the left and right end portions of the platen roller 10 are exposed to the outside when the cover 4 is opened, and may be touched by the operator's fingers. Given this, belt covers 17 schematically indicated by double-dot lines are attached to the cover 4 to hide the exposed portions of the belt mechanism K.

Accordingly, even if the cover 4 is opened, there is little or no possibility that the outward appearance of the printer S is impaired by the belt covers 17 or the belt mechanism K is partially touched by the operator's fingers. This makes it possible to prevent damage of the belt mechanism K and to give a dust-proof effect to the belt mechanism K.

In the portable thermal printer S configured as above, the rolled paper P is stored in the paper storage portion 8 and the tip end of the rolled paper P is drawn out, after which the cover 4 is closed. The rolled paper P thus drawn out is pinched between the thermal printer head 13 and the platen roller 10 and also between the head cover 14 and the paper pressing roller 16.

When the cover 4 is closed, the thermal printer head 13, the platen roller 10, the head cover 14 and the paper pressing roller 16 define a guide path that guides the rolled paper P to the paper outlet 5.

If a drive signal is inputted from a control unit (not shown) to the belt mechanism K, the rolled paper P is guided along the guide path while preventing the oblique motion of the rolled paper P by the oblique motion prevention mechanism D. That is, the rolled paper P is guided toward the paper outlet 5 through the clearance between the thermal printer head 13 and the platen roller 10. The thermal printer head 13 as a printing unit is arranged somewhere along the guide path. As the heater element array generates heat under the control of a control unit, the thermal printer head 13 prints a specified content on the rolled paper P conveyed.

Next, the belt mechanism K will be described in detail.

Figure 4:
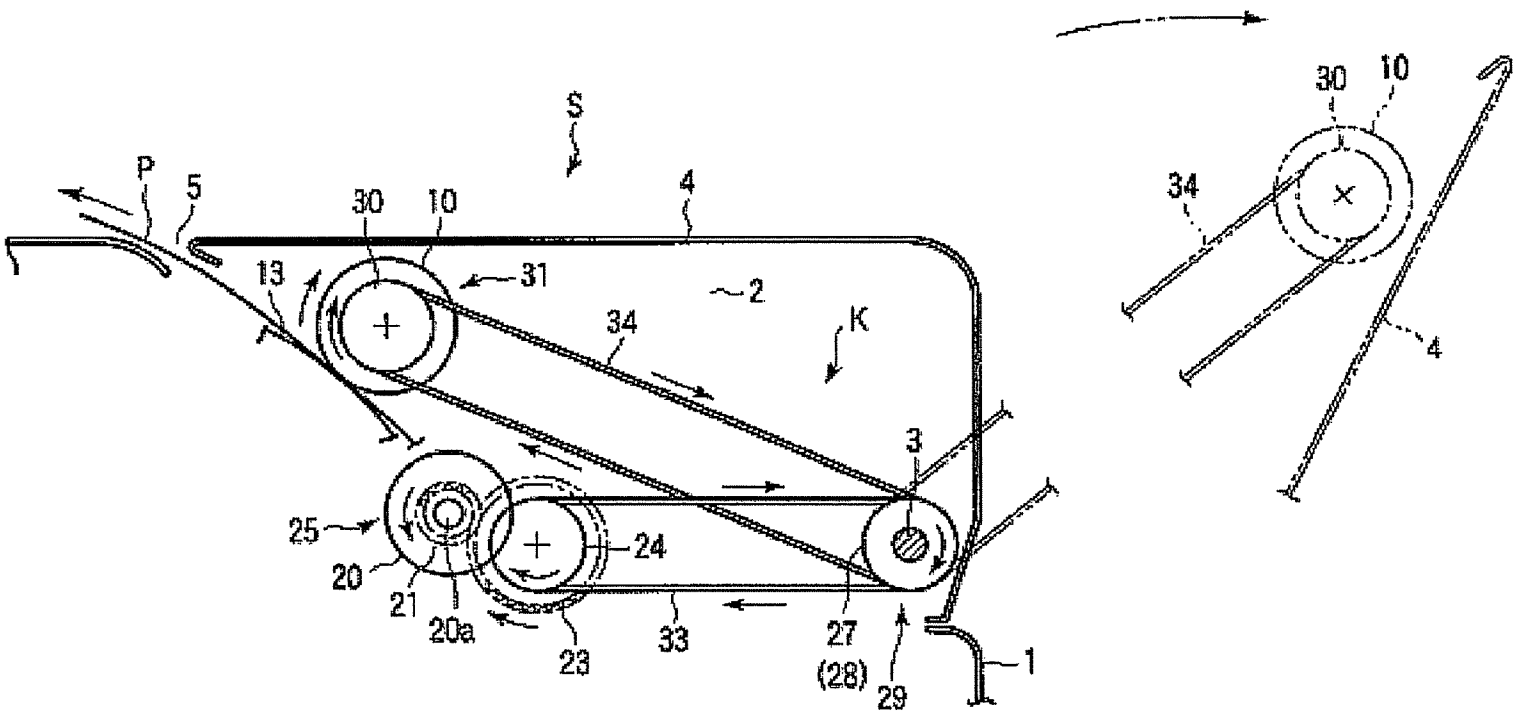
FIG. 4 is a schematic configuration view showing a belt mechanism according to a first embodiment.
Figure 5:
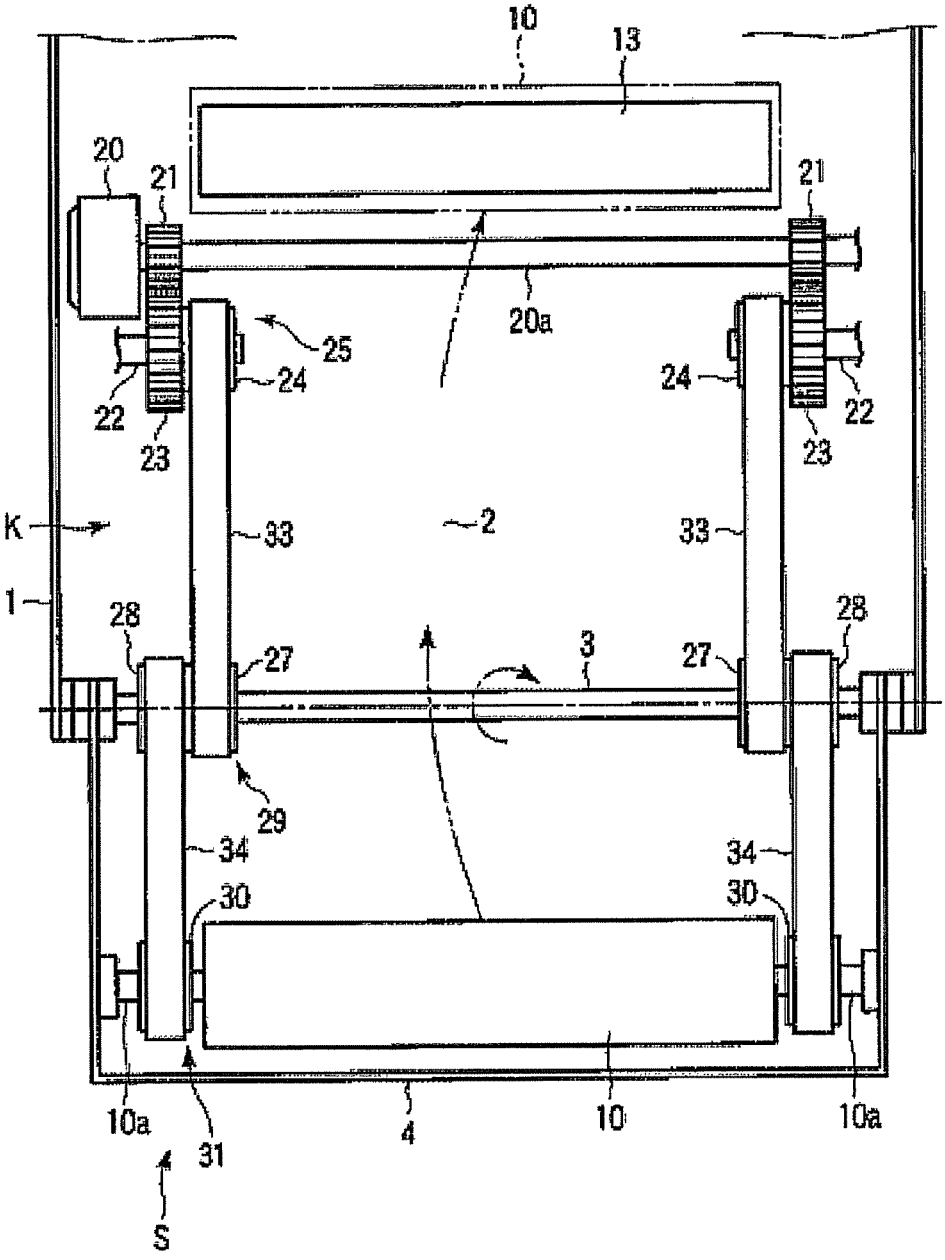
FIG. 5 is a schematic plan view of the belt mechanism shown in FIG. 4.

FIGS. 4 and 5 show a belt mechanism K according to a first embodiment. FIG. 4 is a schematic configuration view of some major parts of the printer S and the belt mechanism K, which depicts the cover 4 in a closed state. FIG. 5 is a schematic plan view of some major parts of the printer S and the belt mechanism K, which depicts the cover 4 in an open state.

When the printer S is seen at the front side, a drive motor (drive power source) 20 is arranged near the left end portion of the thermal printer head 13. The drive motor 20 includes a rotating shaft 20*a* that is extended in the axial direction of the drive motor 20 just in front of the thermal printer head 13.

The tip end of the rotating shaft 20*a* is supported by a bearing not shown in the drawings. Driving gears 21 are attached to the portions of the rotating shaft 20*a* opposing to one end portion and the other end portion of the thermal printer head 13. Support shafts 22 supported by bearings not shown in the drawings are arranged along the left and right end portions of the rotating shaft 20*a*. Driven gears 23 meshed with the driving gears 21 are fitted to the support shafts 22.

First pulleys 24 are fitted to the support shafts 22 in a side-by-side relationship with the driven gears 23. The drive motor 20, the driving gears 21, the driven gears 23 and the first pulleys 24 make up a driving unit 25 of the belt mechanism K.

As mentioned above, the cover 4 for opening and closing the opening portion 2 of the housing 1 is supported by the pivotal shaft 3. Second pulleys 27 are rotatably attached to the left and right end portions of the pivotal shaft 3. Third pulleys 28 are rotatably attached to the pivotal shaft 3 in a side-by-side relationship with the second pulleys 27.

The second pulleys 27 and the third pulleys 28 may be integrally formed with each other or may be independently formed beforehand and then connected to each other by an end-to-end relationship before attaching the pulleys 27 and 28 to the pivotal shaft 3. The second pulleys 27 and the third pulleys 28 make up an intermediate unit 29 of the belt mechanism K.

The platen roller 10 attached to the tip end portion of the cover 4 includes a pair of support shafts 10*a* are axially protruded from the both end portions of the platen roller 10. The support shafts 10*a* are supported on the left and right end portions of the cover 4. Fourth pulleys 30 are fitted to the both end portions of the support shafts 10*a* of the platen roller 10. The fourth pulleys 30 make up a driven unit 31 of the belt mechanism K.

Driving belts 33 are stretched over the first pulleys 24 and the second pulleys 27. Driven belts 34 are stretched over the third pulleys 28 and the fourth pulleys 30. The belt mechanism K is configured as above.

When the opening portion 2 of the housing 1 is closed by the cover 4, the platen roller 10 attached to the cover 4 makes contact with the thermal printer head 13 supported on the housing 1. At the printing startup time, the rolled paper P waits in a state wherein the rolled paper P is pinched between the thermal printer head 13 and the platen roller 10.

Upon receiving a printing signal, the control unit transmits a drive signal to the drive motor 20. As shown in FIG. 4, the rotating shaft 20*a* of the drive motor 20 is rotationally driven counterclockwise and the driving gears 21 are rotated in the same direction together with the rotating shaft 20*a*. The driven gears 23 meshed with the driving gears 21 are rotated clockwise and the first pulleys 24 are rotated in the same direction together with the driven gears 23.

When the driving belts 33 is operated, the second pulleys 27 and the third pulleys 28 are rotated in the same direction as the operation direction of the driving belts 33. When the driven belts 34 are operated, the fourth pulleys 30 are rotated in the same direction as the operation direction of the driven belts 34. The platen roller 10 rotates clockwise with being joined together with the fourth pulleys 30.

Simultaneously, the control unit transmits a printing control signal to the thermal printer head 13 which in turn performs printing on the rolled paper P pinched between the platen roller 10 and the thermal printer head 13. Under the action of the belt mechanism K, the platen roller 10 is rotationally driven to feed the rolled paper P from the opening portion 2 in a direction in which the rolled paper P is discharged to the outside through the paper outlet 5.

In the portable thermal printer S, upon receiving a printing startup signal, a drive signal is inputted to the belt mechanism K to cause the belt mechanism K to rotationally drive the platen roller 10 kept in contact with the thermal printer head 13. Thus, the rolled paper P pinched between the platen roller 10 and the thermal printer head 13 is smoothly discharged to the outside through the paper outlet 5.

On the other hand, the cover 4 needs to be opened with respect to the housing 1, e.g., when the rolled paper P is put into the paper storage portion 8 or when the used rolled paper P is taken out from the paper storage portion 8. In the open state, the driven belts 34 and the fourth pulleys 30 of the belt mechanism K arranged in the cover 4 are protected by the belt covers 17. This eliminates the possibility that dusts or other alien substances adhere to the driven belts 34 and the fourth pulleys 30 of the belt mechanism K.

However, in a conventional structure wherein the driven gears are attached in a coaxial relationship with a platen roller and are exposed to the outside when a cover is opened, dusts or other alien substances are likely to adhere or stick to the driven gears. If the cover is closed again, then the platen roller makes contact with a thermal printer head and the driven gears mesh with driving gears. As the driving gears are rotationally driven, the dusts or other alien substances adhering or sticking to the driven gears are brought into between the driven gears and the driving gears, consequently hindering a smooth rotation of the platen roller and causing a reduction of the printing accuracy.

According to the present embodiment, even if the cover 4 is opened, only the driven belts 34 and the fourth pulleys 30 of the belt mechanism K are exposed to the outside. Accordingly, even if the cover 4 is opened in a place where a myriad of dusts or other alien substances flies, there is no possibility that dusts or other alien substances are infiltrated into the belt mechanism K. This makes it possible to maintain drive efficiency and to assure smooth rotation of the platen roller 10.

Figure 6:
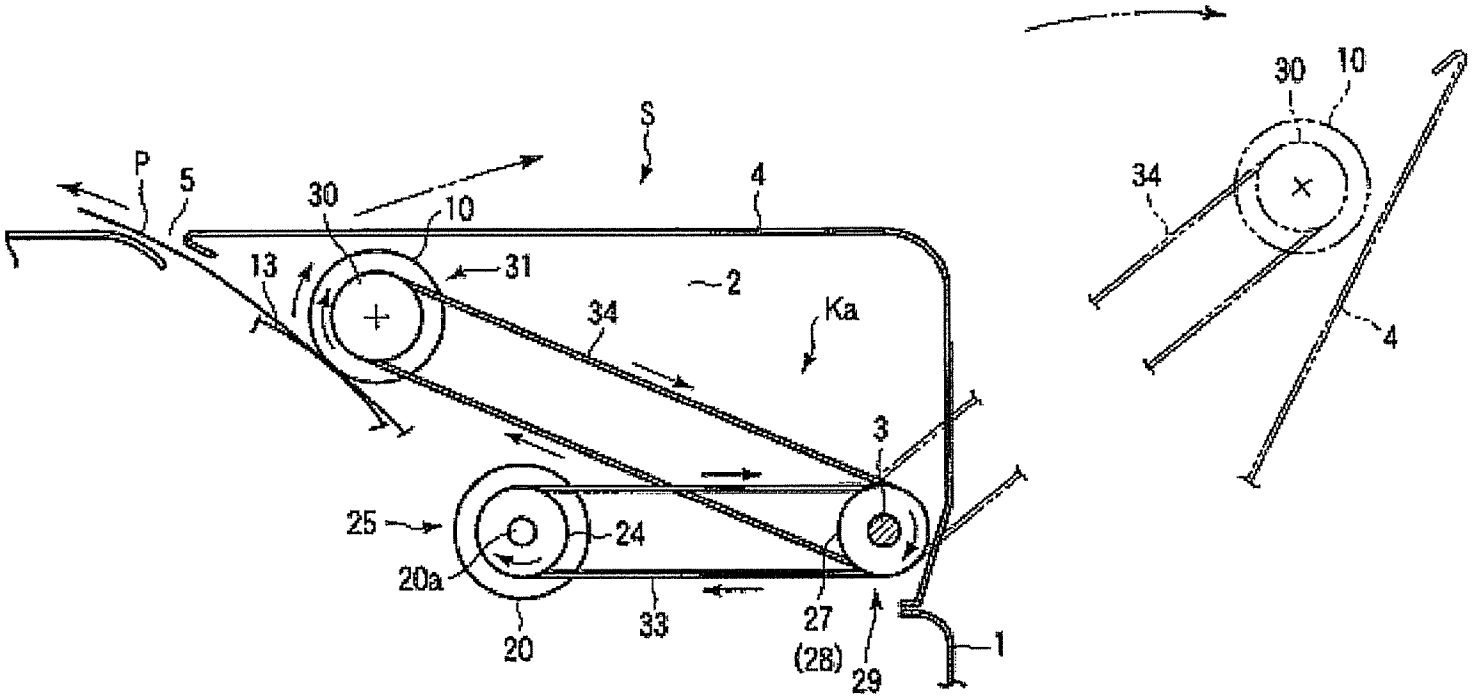
FIG. 6 is a schematic configuration view showing a belt mechanism according to a second embodiment.
Figure 7:
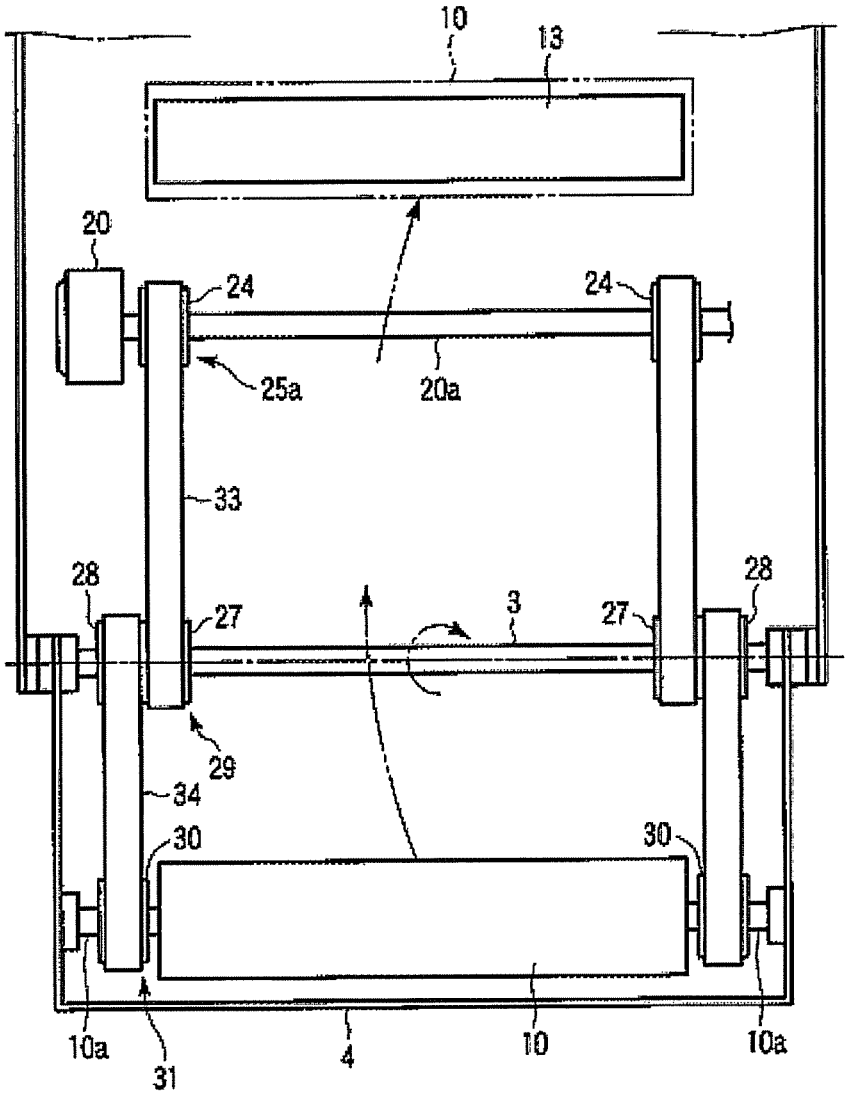
FIG. 7 is a schematic plan view of the belt mechanism shown in FIG. 6.

FIG. 6 is a schematic configuration view of some major parts of the printer S and the belt mechanism Ka according to a second embodiment, which depicts the cover 4 in a closed state. FIG. 7 is a plan view of some major parts of the printer S and the belt mechanism Ka of the second embodiment, which depicts the cover 4 in an open state.

In this embodiment, the belt mechanism Ka includes a driving unit 25*a* wherein the first pulleys 24 are directly fitted to the rotating shaft 20*a* of the drive motor 20. More specifically, unlike the belt mechanism K of the first embodiment, the belt mechanism Ka of the present embodiment does not employ the driving gears 21 and the driven gears 23 making up the driving unit 25. Instead, the driving unit 25*a* of the belt mechanism Ka includes only the drive motor 20 and the first pulleys 24. This means that a motor capable of rotating at a low speed needs to be used the drive motor 20.

The second pulleys 27 and the third pulleys 28 are integrally formed with each other to make up the intermediate unit 29. The fourth pulleys 30 are installed on the support shafts 10*a* of the platen roller 10 to make up the driven unit 31. The driving belts 33 are stretched over the first pulleys 24 and the second pulleys 27. The driven belts 34 are stretched over the third pulleys 28 and the fourth pulleys 30.

If a drive signal is inputted to the drive motor 20, then the first pulleys 24 are directly rotated by the drive motor 20 and the driving belts 33 is operated. As a result, the driven belts 34 are operated so that the platen roller 10 is rotationally driven. Thus, the rolled paper P pinched between the platen roller 10 and the thermal printer head 13 is fed and discharged through the paper outlet 5.

In the second embodiment, the driving unit 25*a* of the belt mechanism Ka arranged within the housing 1 does not employ the meshing structure of the driving gears 21 and the driven gears 23 employed in the first embodiment. As such, even if dusts or other alien substances are infiltrated into the housing 1, it is possible to reliably prevent reduction of the drive efficiency and to assure smooth rotation of the platen roller 10.

Figure 8:
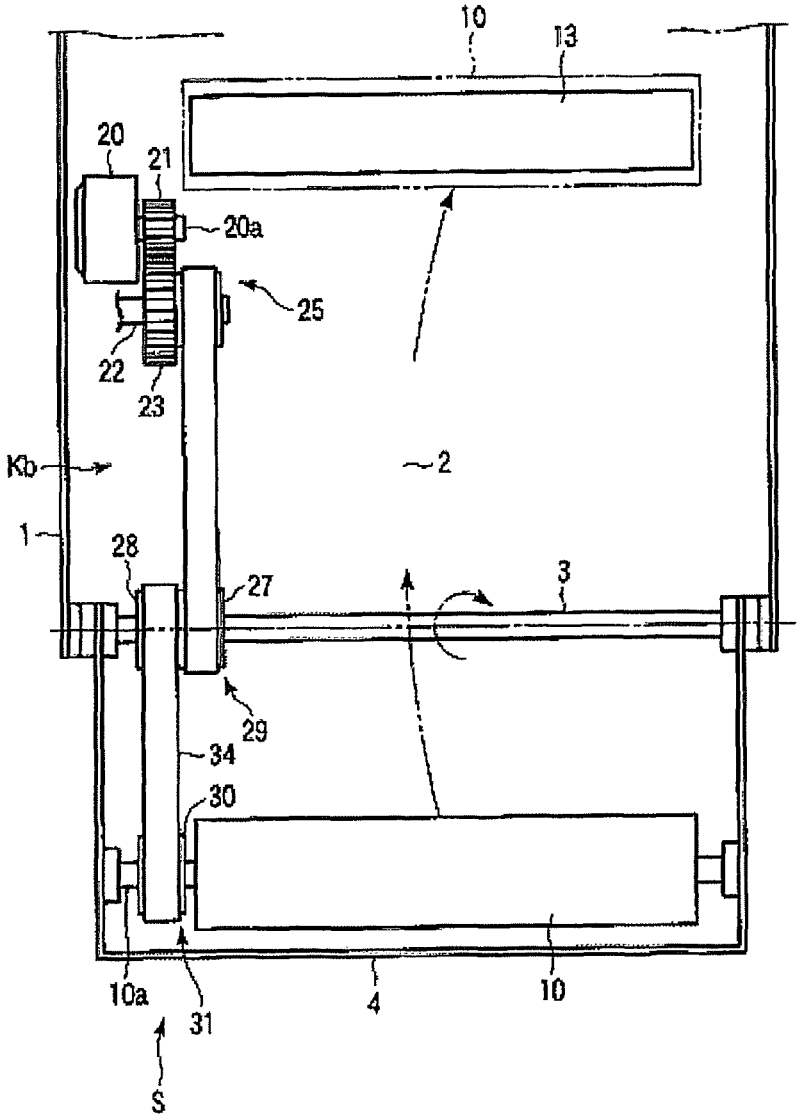
FIG. 8 is a schematic plan view showing a belt mechanism according to a third embodiment.

FIG. 8 is a schematic plan view of some major parts of the printer S and the belt mechanism Kb according to a third embodiment, which depicts the cover 4 in an open state. The third embodiment has essentially the same configuration as that of the first embodiment. The belt mechanism Kb of the third embodiment is characterized in that the first pulley 24, the second pulley 27, the third pulley 28, the fourth pulley 30, the driving belt 33 and the driven belt 34 are provided only in one end portions of the thermal printer head 13, the pivotal shaft 3 and the platen roller 10.

This assists in maintaining the drive efficiency of the belt mechanism Kb, assuring smooth rotation of the platen roller 10, reducing the transverse dimension of the housing 1 and the cover 4, enhancing the portability of the portable thermal printer S and reducing the cost.

The configuration of the third embodiment may be modified to a configuration in which the first pulleys 24 is directly fitted to the drive motor 20 as in the second embodiment to thereby omit the meshing structure of the driving gears 21 and the driven gears 23 employed in the first embodiment. This modified configuration can additionally enjoy the same effects as provided by the second embodiment.

While certain embodiments have been described, these embodiments have been presented by way of example only, and are not intended to limit the scope of the inventions. Indeed, the novel printers described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A portable thermal printer, comprising:

a housing provided with a thermal printer head;

a cover openably attached to an opening portion of the housing by a pivotal shaft, the cover being provided with a platen roller arranged to make contact with the thermal printer head when the opening portion of the housing is closed by the cover; and a drive power source provided within the housing, the drive power source being connected with the pivotal shaft and the platen roller by a belt mechanism.

2. A portable thermal printer, comprising:

a housing provided with a thermal printer head;

a cover openably attached to an opening portion of the housing by a pivotal shaft, the cover being provided with a platen roller arranged to make contact with the thermal printer head when the opening portion of the housing is closed by the cover;

a drive power source provided within the housing;

a first pulley connected to the drive power source;

a second pulley attached to the pivotal shaft;

a third pulley arranged to rotate with being joined together with the second pulley;

a fourth pulley attached to the platen roller;

a driving belt stretched between the first pulley and the second pulley; and a driven belt stretched between the third pulley and the fourth pulley.

3. The printer of claim 2, further comprising:

a driving gear connected to the drive power source; and a driven gear connected to the first pulley, wherein the driven gear is meshed with the driving gear so that the first pulley is connected to the drive power source.

4. The printer of claim 2, wherein the first pulley is attached to a rotating shaft of the drive power source.

5. The printer of claim 3, wherein the first pulley, the second pulley, the third pulley, the fourth pulley, the driving belt and the driven belt are provided in pair and arranged at both end portions of the thermal printer head and the platen roller.

6. The printer of claim 3, wherein the first pulley, the second pulley, the third pulley, the fourth pulley, the driving belt and the driven belt are arranged in only one end portions of both end portions of the thermal printer head and the platen roller.

7. The printer of claim 2, further comprising:

a heater element array provided within the thermal printer head;

wherein the heater element array is contacted with the platen roller when the cover is closed.

8. The printer of claim 2, further comprising:

a paper pressing roller provided within the cover; and a head cover provided within the thermal printer head, wherein the paper pressing roller is contacted with the head cover when the cover is closed.

* * * * *